US007262672B2

(12) United States Patent
Lee et al.

(10) Patent No.: US 7,262,672 B2
(45) Date of Patent: Aug. 28, 2007

(54) COAXIAL CONNECTOR AND CONNECTION STRUCTURE INCLUDING THE SAME

(75) Inventors: Hai-Young Lee, Gyeonggi-do (KR); Yong-Goo Lee, Seoul (KR); Kyoung-Il Kang, Gyeongsangnam-do (KR)

(73) Assignee: Gigalane Co., Ltd., Suwon (KR)

( * ) Notice: Subject to any disclaimer, the term of this patent is extended or adjusted under 35 U.S.C. 154(b) by 54 days.

(21) Appl. No.: 10/509,984

(22) PCT Filed: Mar. 26, 2003

(86) PCT No.: PCT/KR03/00597

§ 371 (c)(1),
(2), (4) Date: Sep. 30, 2004

(87) PCT Pub. No.: WO03/084001

PCT Pub. Date: Oct. 9, 2003

(65) Prior Publication Data

US 2005/0176292 A1 Aug. 11, 2005

(30) Foreign Application Priority Data

Apr. 1, 2002 (KR) ..... 10-2002-0017748

(51) Int. Cl.
*H01P 5/08* (2006.01)

(52) U.S. Cl. ..... 333/33; 333/260; 439/63; 439/578; 439/581

(58) Field of Classification Search ..... 333/33, 333/34, 260; 439/63, 578, 581
See application file for complete search history.

(56) References Cited

U.S. PATENT DOCUMENTS 4,690,482 A * 9/1987 Chamberland et al. ..... 439/578
5,570,068 A * 10/1996 Quan ..... 333/33
6,015,315 A 1/2000 Ensign et al.

FOREIGN PATENT DOCUMENTS

JP 1998-289767 10/1998
JP 2001-177311 A 6/2001

(Continued)

OTHER PUBLICATIONS

English Abstract of Korean Publication No. 2000-0004040 U Published Feb. 25, 2000.

(Continued)

*Primary Examiner*—Stephen E. Jones
(74) *Attorney, Agent, or Firm*—Marger Johnson & McCollom, P.C.

(57) ABSTRACT

The present invention relates to a connection structure in which an inner conductor is combined with a detachable impedance compensator as well as a coaxial connector, an extendible pin and an impedance compensator used for the connection structure. Further, this invention relates to a microwave device connected both electrically and mechanically with the connection structure. An impedance compensation thereof means compensates electric discontinuities between the inner conductor and the extendible pin by mechanical arraying with a microwave device to be combined with the connection structure, whereby the protrusion formed at the impedance compensation means satisfies the conditions, $b \leqq a/5$ and $c \leqq 2b$, when diameter of the impedance compensation means is a, thickness thereof is b, and size of the protrusion is c.

8 Claims, 17 Drawing Sheets

FOREIGN PATENT DOCUMENTS

| | | | |
|---|---|---|---|
| KR | 2000-0004040 | U | 2/2000 |
| KR | 2001-0091539 | A | 10/2001 |

OTHER PUBLICATIONS

English Abstract of Korean Publication No. 2001-0091539 A Published Oct. 23, 2001.

English Abstract of Japanese Publication No. 1998-289767 Published Oct. 27, 1998.

English Abstract of Japanese Publication No. 2001-177311 Published Jun. 29, 2001.

* cited by examiner

COAXIAL CONNECTOR AND CONNECTION STRUCTURE INCLUDING THE SAME

TECHNICAL FIELD

The present invention relates to a coaxial connector for high frequency transmission line. More particularly, this invention relates to a connection structure in which an inner conductor is combined with a detachable impedance compensator as well as a coaxial connector, an extendible pin and an impedance compensator used for the connection structure. Further, this invention relates to a microwave device connected both electrically and mechanically with the connection structure.

In most areas of high frequencies and microwaves, a coaxial transmission line consists of an inner conductor and an outer conductor. The inner conductor is made of a wire, while the outer conductor being normally made of twisted metallic string bundles. The inner conductor and the outer conductor are electrically insulated by a dielectric material.

With recent increase in the use of coaxial line in wireless communication fields, the frequencies of signals transmitted through a coaxial line has also been drastically increased to e.g., 18 GHz or 26.5 GHz, and thus electric characteristics required for a coaxial transmission line connector becomes more strict. In particular, where frequent insertions and separations of the connector are required e.g., for testing a microwave element, it should be maintained that a rapid electric connection while maintaining a low VSWR (Voltage Standing Wave Radio), superior electrically detaching characteristics, accurate impedance matching, signal integrity, and the propagation characteristics.

BACKGROUND ART

Since a conventional coaxial connector comprises a thick inner conductor, it can hardly be installed on a small sized thin high frequency plate, and its performance characteristics drop drastically at a frequency over 6 GHz. A connector structure 10, wherein size of the inner conductor has been reduced gradually to allow the inner conductor to fit to a high frequency substrate, and diameter of the dielectric material has also been reduced to enable the impedance to be maintained at 50Ω, is show in FIG. 1.

The conventional connector 10 in FIG. 1 comprises an outer conductor 12, first dielectric 14 and an inner conductor 16. The connector 10 is electrically connected to a micro stripline (not shown in the drawing) of a microwave device 20 when it is installed within the microwave device 20. The inner conductor 16 of the connector 10 is electrically connected to an extendible pin 18. A second dielectric 30 made of fluorine-resin (Teflon) and inserted into a hole 22 of the microwave device 20 and the extendible pin 70 inserted into a hole 32 formed in the center of the second dielectric 30 are for impedance matching.

The inner conductor 16 of conventional connector 10 in FIG. 1 has a diameter reduced step-by-step toward the microwave device 20. Furthermore, size of dielectric 14 is also gradually changed to maintain an impedance of 50Ω. Thus, manufacturing of the dielectric 14 and of the inner conductor 16 becomes very troublesome; reflection property of the transmitted microwave signals is worsen due to the reflection of the microwave signals transmitted through the inner conductor, triggered by the varying conductor size; and a drastic drop of the performance characteristics occurs when the connector is connected to a transmission line. Actually, with the connector connected to a micro strip, a satisfactory performance cannot be expected at a frequency of 18 GHz or over. In addition, in the course of fixing the inner conductor by second dielectric, the thin inner conductor can be disconnected by heat of liquid form dielectric, and a correct line up of the extendible pin with the dielectric is also very difficult.

FIG. 2 shows another coaxial connector with conventional structure. Since main body of the connector 50 is made in detachable manner, this connector 50 is advantageous in recycling purposes or in exchanges at site. The connector 50 comprises an outer conductor 52, a dielectric 54, air 55, and an inner conductor 56. The connector 50 is connected mechanically to a microwave device through a connection means, e.g. bolt 57. An extendible pin 70 is inserted into the inner conductor 56 of the connector 50. Here, an extendible pin 70 is inserted into a bead form dielectric 80 made of melted glass ceramic with high dielectric ratio in order to compensate the difference in size of the extendible pin 70 from that of the inner conductor 56, and then, the dielectric 80 is inserted into the hole 65 of the microwave device 60 to yield a tightly sealed structure. In order to make a sealing construction, the hole 65 of the microwave device 60 has a two stage structure, e.g. the hole 65 consists of a first insertion stage with a diameter of 0.7 mm corresponding to the thin diameter of the inner conductor 56 to maintain an impedance of 50Ω and a second insertion stage corresponding to the diameter of the extendible pin 70. The extendible pin 70 is electrically connected to the micro strip 62 of the microwave device 60 after it has passed through the second insertion stage.

However, in order to enable a connection with the conventional connector in FIG. 2, a two stage drilling of the microwave device is required, which is not advantageous. Since diameters and depths of the insertion holes of a microwave device are very sensitive to the overall performance characteristics of the connection structure, the insertion holes shall preferable be made as simple as possible. Moreover, manufacturing of the glass ceramic for the sealing structure is troublesome and requires a high cost.

DISCLOSURE OF THE INVENTION

The present invention, (conceived to solve the above problems,) aims to provide a coaxial connector with superior electric characteristics, especially in high frequencies, and a connection structure including the same.

Another objective of the present invention is to provide a coaxial connector having a simple construction, an easy manufacturing process, as well as a low manufacturing cost, and a connection structure including the same.

Still another objective of the present invention is to provide a coaxial connector showing superior characteristics in respect to insertion loss as well as reflection at an ultra high frequency on or over 15 GHz, and a connection structure including the same.

Finally, another objective of the present invention is to provide a connection structure having a suitable construction for transmitting signals externally from ultra high frequency module packages through a micro strip transmission line, as well as a coaxial connector, an extendible pin, an impedance compensator, and a microwave device used for this connection structure, to be connected with the impedance compensator and the connection structure.

In order to achieve the above objectives, a connection structure in accordance with the present invention, is for transmission of high frequency signals, and comprises a connector body, which constitutes the outer appearance as well as housing of the connector; an inner conductor installed in the connector, including a first and a second terminals which are placed to face each other; a dielectric which insulates the connector body from the inner conductor and determines impedance of the connector; an extendible pin, which is connected electrically to the second terminal of the inner conductor; and an impedance compensation means having a hole for the extendible pin, whereby diameter of the inner conductor remains practically identical between the first and the second terminals, while diameter of the extendible pin is smaller than that of the inner conductor. The impedance compensation means compensates electric discontinuities between the inner conductor and the extendible pin by mechanical arraying with a microwave device to be combined with the connection structure, whereby the protrusion formed at the impedance compensation means satisfies the conditions, $b \leqq a/5$ and $c \leqq 2b$, when diameter of the impedance compensation means is a, thickness thereof is b, and size of the protrusion is c.

In another embodiment of the connection structure as per the present invention, appropriate modifications of constructions of the coaxial connector, the impedance compensation means, the extendible pin, and/or the microwave device to be combined with the connection structure, are made to achieve an impedance matching. For example, an impedance matching could be maintained by constructing the impedance compensation means as a circular dielectric made of Teflon with or without a protrusion in the center of the dielectric. Alternatively, the extendible pin could be so constructed as to include a peak part and an extendible part, the latter having a larger diameter than that of the former, and to create a space when the extendible pin is combined with the circular groove of the inner conductor such that impedance of the connection structure is controlled by the size of this space; or, a plurality of through holes are formed in the body of the impedance compensation means to allow an impedance control by varying location and/or size of these through holes. Further, an impedance matching can also be achieved by appropriate modification of the construction of the dielectric ring or of the combination between the dielectric ring and the substrate of the microwave device in a state a dielectric ring is inserted at a side of the extendible pin opposite to the side where the impedance compensation means is combined.

EMBODIMENTS OF THE INVENTION

Below, a detailed description of the embodiments of the present invention is given making reference to the accompanying drawings.

Figure 1:
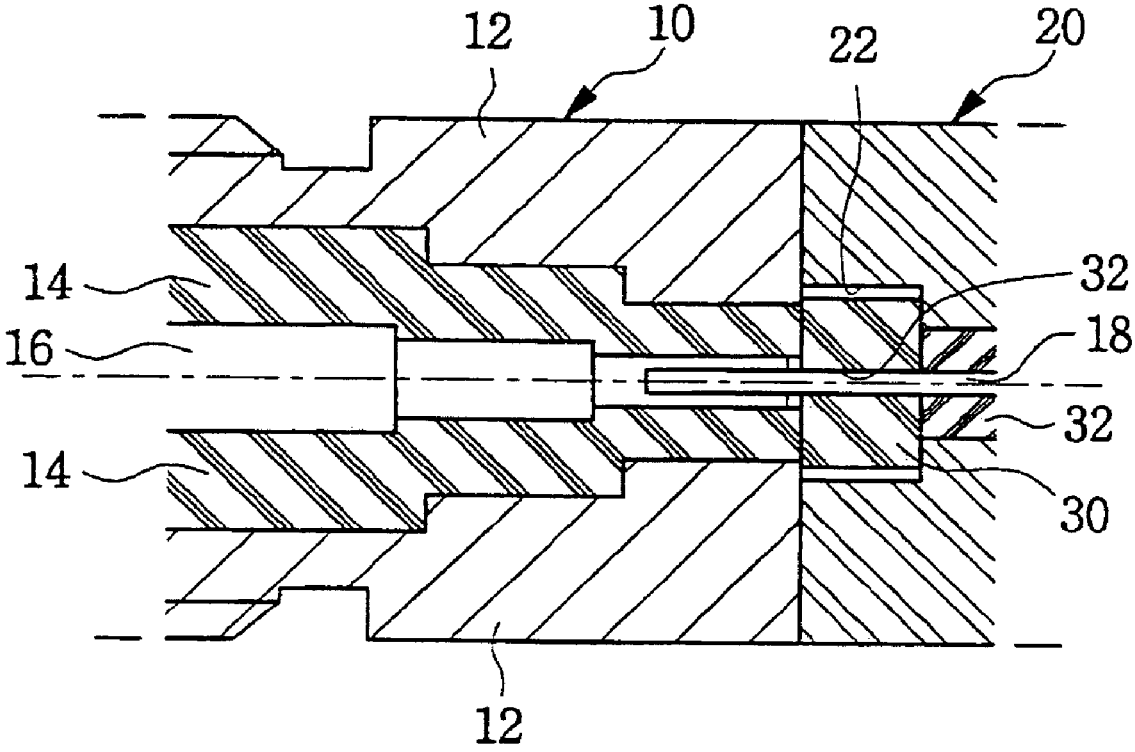
FIG. 1 PRIOR ART
FIG. 1 is a cross-sectional view of a conventional connection structure including a coaxial connector as combined with a microwave device.
Figure 2:
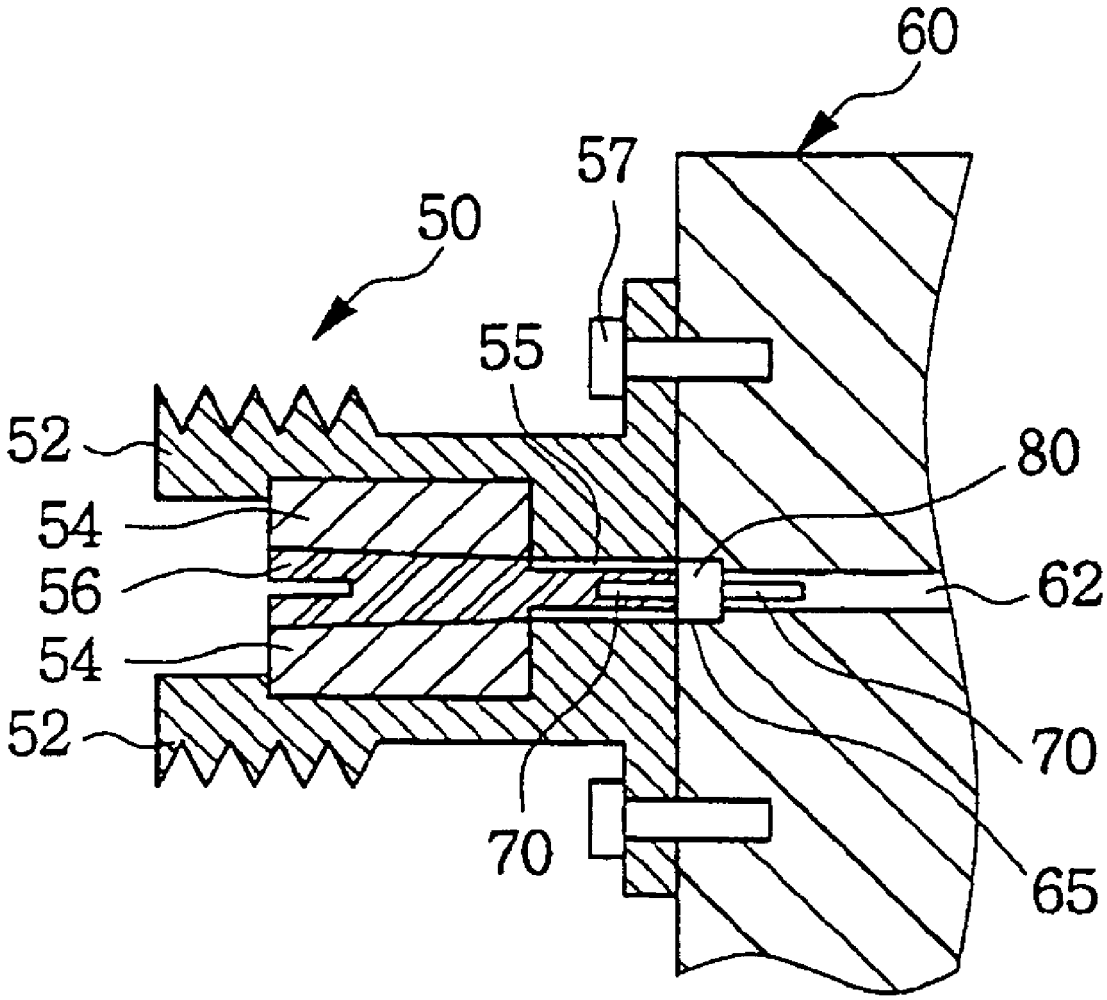
FIG.2 PRIOR ART
FIG. 2 is a cross-sectional view of another conventional connection structure including a coaxial connector as combined with a microwave device.
Figure 3:
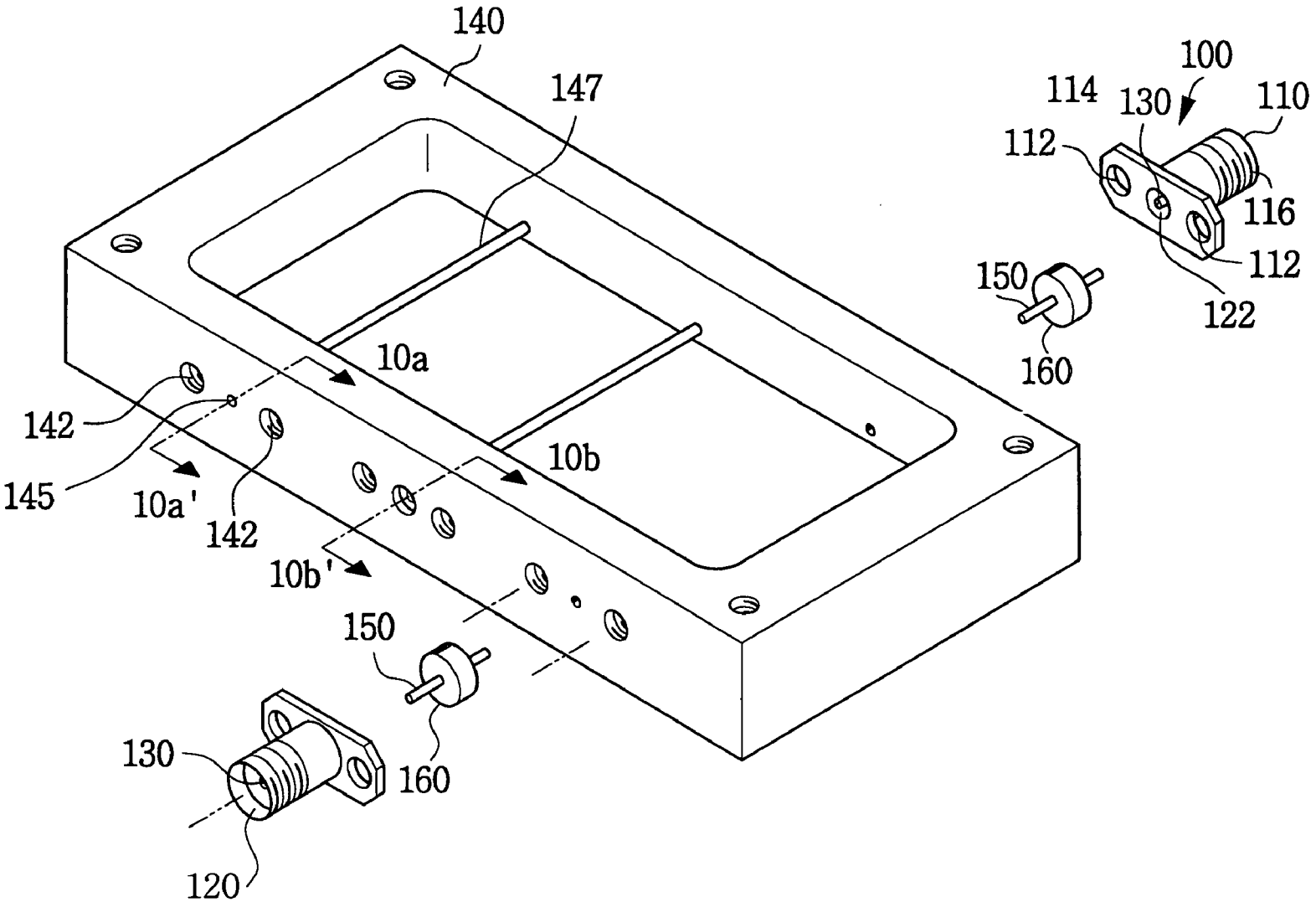
FIG. 3 is a perspective view showing a connection structure in accordance with the present invention and a microwave device.

FIG. 3 is a perspective view showing a connection structure in accordance with the present invention and a microwave device.

As shown in FIG. 3, a coaxial connector 100 comprises a body 110, a dielectric 120, and an inner conductor 130. The connection structure comprises a coaxial connector 100, an extendible pin 150, and an impedance compensator 160. The coaxial connector 100 as in FIG. 3 can be, e.g. an SMA (Sub-Miniature Series A) 2.92 mm or 3.5 mm arm connector, whereby an SMA interface observes, for example, International Standard MIL-C-39012, and is used in transmitting ultra high frequencies of 18 GHz or 26.5 GHz to high frequency devices such as wireless communication devices and test instruments. However, persons skilled in the art to which the present invention belongs will easily understand that the present invention is not limited to SMA type connectors, but allows all microwave connectors to be generally used therein. For example, the present invention can be applied to N series connectors, TNC connectors, BNC connectors, F series and G series connectors can be used in the present invention, in addition to DIN connectors, OSMP connectors, SMB connectors, MCX connectors, SSMT connectors, OSMT connectors, MMXC connectors. Furthermore, the present invention can also be applied to 0.141, 0.250, 0.0853, 0.144, RG316, RG188, ½", and ⅞" right angled connectors, semi-rigid, or semi-flexible coaxial cables.

Body of the connector 110 can be made of stainless steel or other non-ferrous metal, and can be plated by gold, white bronze, etc. The connector body 110 comprises combination holes 112, an inner conductor hole 114, and a combination means 116. The combination holes are for fixing the coaxial connector 100 with a microwave device 140, and the inner conductor hole 114 enables the inner conductor 130 to be exposed outward, while the combination means 116 is for combination of the coaxial connector 100 with a male connector (not shown in the drawing), whereby inner conductor 130 of the coaxial connector 100 is combined with inner conductor of a coaxial cable through the male connector. Although the combination means 116 is embodied in FIG. 3 as a screw, the present invention is not limit thereto, it can also take, e.g. a plug structure.

The inner conductor 130 is surrounded by dielectric material 120, and the body 110 formed at outer edges of the dielectric material 120 is electrically connected to the outer conductor (not shown in the drawing) of the coaxial cable, whereby the outer conductor is usually used as a ground plane, while the inner conductor 130 is used for transmission of microwave signals. The inner conductor 130 is electrically connected to the extendible pin 150. The extendible pin 150 inserted in an impedance compensation means 160 to be combined with a connection structure, or the dielectric material is inserted after inserting the the extendible pin. The impedance compensation means 160 is made, e.g. of Teflon. The impedance compensation means 160 is for establishing impedance matching between the coaxial connector 100 and the transmission line 147.

A variable defining characteristics of a signal frequency structure of a cable, a connector, etc. is impedance, whereby a maximum energy can be transmitted when the impedances between two signal transmitting means are the same, i.e. when an impedance matching is established between them. However, when impedance changes are short in comparison to the wavelength, the signal loss by impedance mismatching can be ignored. Though the norm impedances of a coaxial cable are 50Ω, 75Ω, 93-125Ω, etc., a 50Ω cable is generally used as a compromise between a maximum power transmission and a minimum line loss. On the other hand, in communication and broadcasting industries, 75Ω cables are generally used to minimize the line loss. As such, the impedance compensator 160 can be appropriately adjusted in different applications. If the impedance changes in the course of signal transmission from the connector 100 to the microwave device 140, a reflection loss is generated due to partial reflection of the wave entered into the microwave device 140, and if the impedance is changed repeatedly, multiple reflections occur. Here, the total reflection coefficient equals to the vector sum of all reflection coefficients. These multiple reflections cause a resonance phenomenon.

The coaxial connector 100 is electrically connected to the transmission line 147 of the microwave device 140 via the inner conductor 130 and the extendible pin 150.

The microwave device 140, being made of, e.g. aluminum or brass, is connected through the coaxial connector 100 and the coaxial cable to another electronic device, e.g. a Vector Network Analyzer (not shown in the drawings) to exchange microwave signals. Although FIG. 3 shows a microwave device 140 of quite simple construction for convenience of explanation, such microwave device 140 can be, for example, a coupler, a modulator, an amplifier or a spectrum analyzer. Body of the microwave device 140, comprises insertion holes 145 at both sides for insertion of an extendible pin 150, in which holes 145, only the extendible pins 150 are inserted, or together with an impedance compensator 160, as shown in FIGS. 4 through 9, an explanation of such cases is given below.

The microwave device 140 comprises combination holes 142 which pair with the combination holes 112 of the connector 100 so that the connector 100 is fixed to the microwave device 140 through these holes (112, 142). The insertion holes 145 at both sides of the body of the microwave device 140 are formed to face each other in pairs, and a transmission line 147 is placed on the strait line formed between by these pairs of insertion holes 145. The transmission line 147 is formed on a high frequency circuit board, however, an illustration of the circuit board is omitted here, to simplify the drawing. The transmission line 147 can be, e.g. a micro strip line, of which the width is determined by a function of the dielectric rate of the circuit board in use with the thickness thereof. That is, a relation expressed by $w=f(\in, h)$ is valid when width of the micro strip line is w, dielectric rate of the circuit board is $\in$, and thickness of the circuit board is h.

In other embodiments of a connection structure according to the present invention, inner conductor 130 of a coaxial connector 100, dielectric material 120, impedance compensator 160, insertion holes 145 of a microwave device 140, are formed to have various constructions, a description thereof follows below making reference to the accompanying drawings.

First Embodiment

FIGS. 4*a* through 4*d* are cross-sectional views of a first embodiment of a connection structure in accordance with the present invention.

Figure 4A:
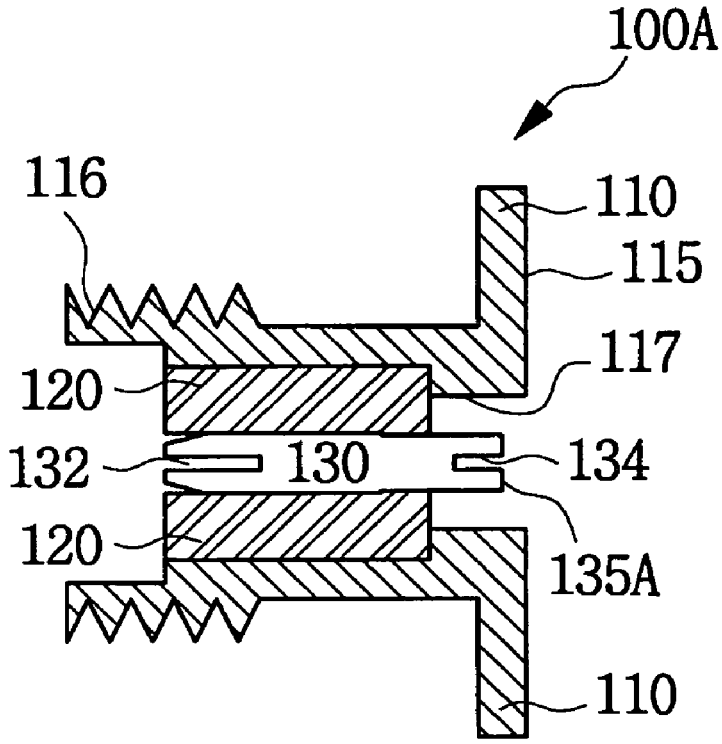
FIGS. 4*a* through 4*d* are cross-sectional views of a first embodiment of a connection structure in accordance with the present invention.
Figure 4B:
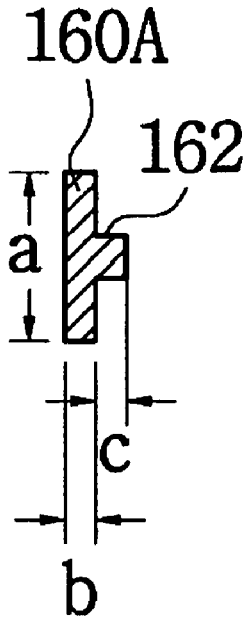
Figure 4C:
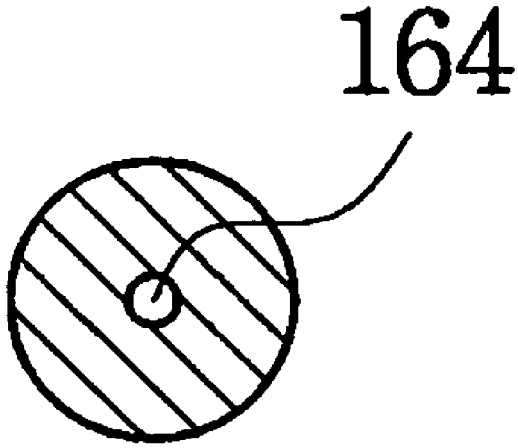
Figure 4D:
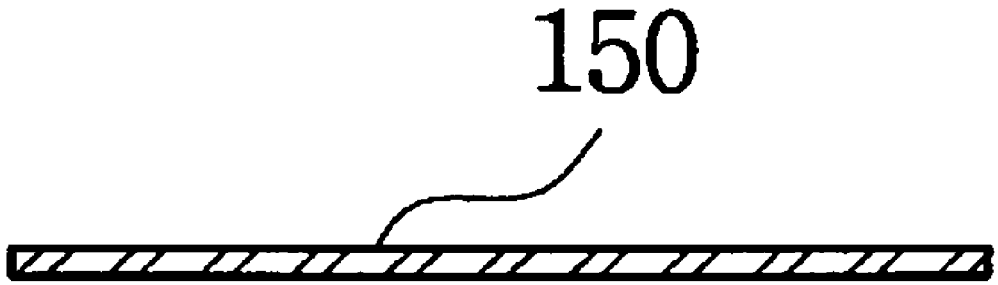
Figure 5A:
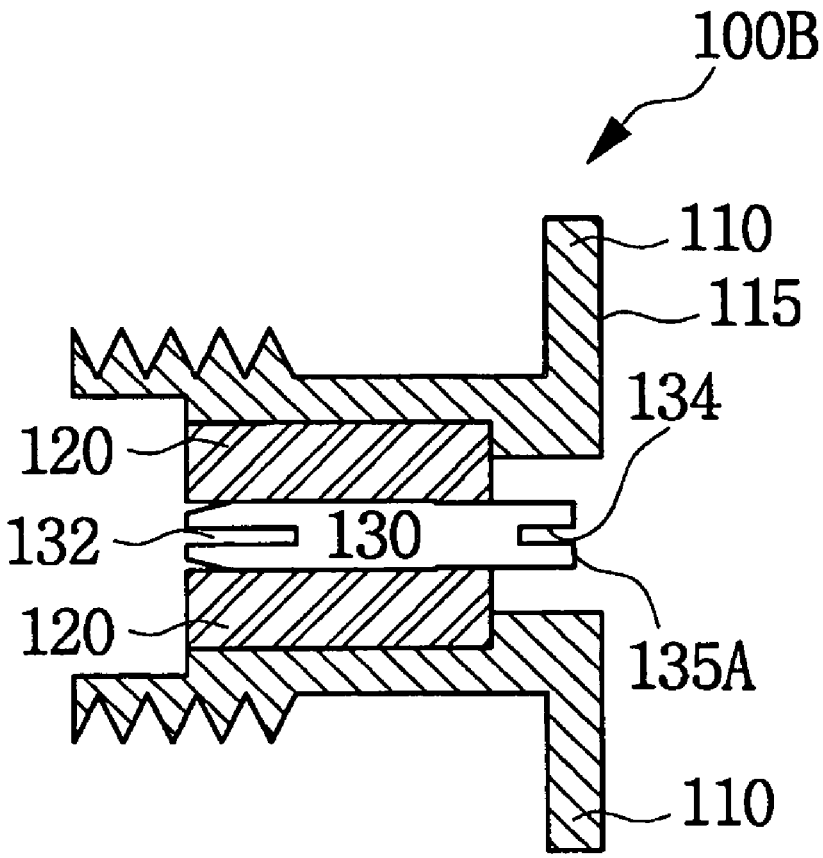
FIGS. 5*a* through 5*d* are cross-sectional views of a second embodiment of a connection structure in accordance with the present invention.
Figure 5B:
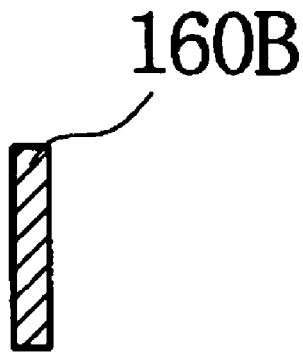
Figure 5C:
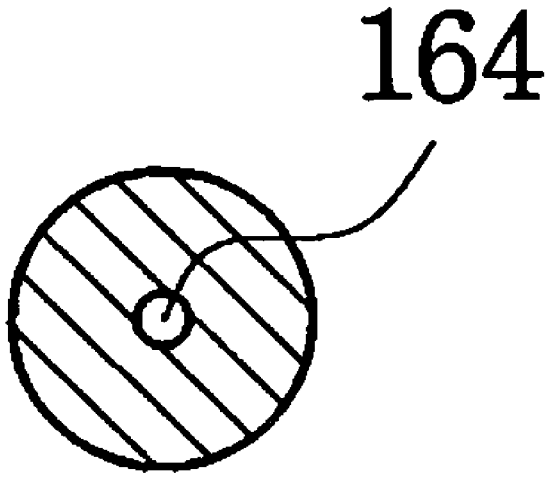
Figure 5D:
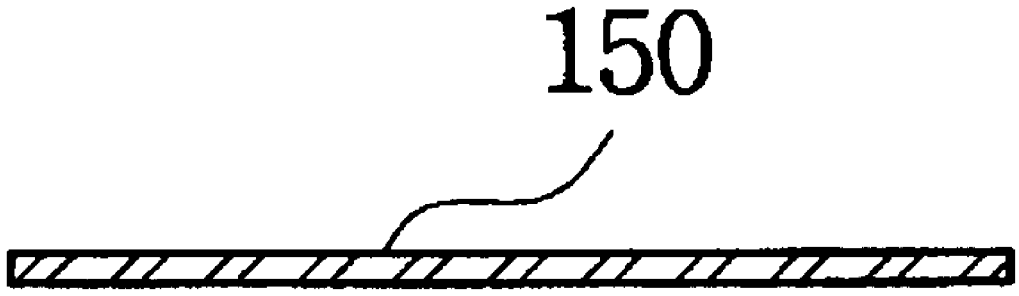

The coaxial connector 100*a* in FIG. 4*a* comprises a body 110 and an inner conductor 130. FIGS. 4*b* and 4*c* illustrates a cross-sectional view and a front view, respectively, of the impedance compensator 160*a*, while FIG. 4*d* shows a cross-section view of the extendible pin 150. A connection structure as per the present invention comprises a connector 100*a*, an extendible pin 150, and an impedance compensator 160*a*.

Referring to FIG. 4*a*, the body 110 of the coaxial connector 100*a* shapes the overall outer appearance of the connector 100*a*, includes a combination means 116 for connection with a male connector (not shown in the drawing), and is connected to an outer conductor of the coaxial cable, i.e. to a ground. Dielectric material 120 within the body 110 surrounds the inner conductor 130, and has the same size in general. It is possible to form a part of the dielectric material 120 by air gap.

The inner conductor 130 comprises a first terminal 132 to be electrically connected to an inner conductor of a male connector, and a second terminal 134 to be electrically connected to an extendible pin 150. The grooves formed in the first and the second terminals 132, 134 are for reducing electric resistance (at the contacting parts) by improving the electric contacts. The inner conductor 130 maintains practically the same diameter between the first and the second terminals 132, 134, without any significant change, whereby diameter of the inner conductor 130 is much bigger than that of the extendible pin 150.

In the first embodiment of the present invention, the ending part 135*a* of the second terminal 134 of the inner conductor 130 is formed deeper than the terminal surface 115 of the connector body 110, i.e. the inner conductor 130 is constructed not to protrude outward over the connector body 110. Further, in the first embodiment of the present invention, the impedance compensator 160*a* comprises a protrusion 162 in the center as shown in FIG. 4*b*, and a hole 164 is formed in the central protrusion as shown in FIG. 4*c*, into which hole 164 an extendible pin 150 is inserted. The impedance compensator 160*a* is inserted into the hole 117 of the body 110 in a manner that the surface of the impedance compensator 160*a* with protrusion 164 fits to the terminal surface 115 of the connector body. Accordingly, in a connection structure, wherein the impedance compensator 160 is combined with the connector body, the protrusion part 162 of the impedance compensator 160*a* and only a part of the extendible pin 150 inserted in the hole 164 protrude outward over the terminal surface 115. A connection structure as per the first embodiment of the present invention, is combined with a microwave device 140 as shown in FIG. 3 in a manner that the protrusion 162 is fitted into the insertion hole 145, so that the protrusion 162 could be used as a fitting key without requiring an additional means for correct arraying when the extendible pin 150 is inserted into the insertion hole 145 of the microwave device 140.

Since the inner conductor 130 of the connector has a diameter largely different from that of the extendible pin 150 as described above, the impedance difference between these two are big. The impedance compensator 160*a* compensates this electric discontinuity through instrumental arraying and achieves an impedance matching. Here, the instrumental arraying means an instrumental arraying between the connection structure and a microwave device with which this connection structure is combined.

A variable defining characteristics of a signal frequency structure of a cable, a connector, etc. is called characteristics impedance ZO. The characteristics impedance of a no loss cable, being related to the per length inductance L and per length capacitance C, can be expressed by the following Formula 1.

$$ZO=\sqrt{(L/C)}[\Omega] \qquad \text{[Formula 1]:}$$

Characteristics impedance of a coaxial cable can be expressed by the following Formula 2.

$$Z0=138/\sqrt{\in}\text{Log } 10(D/d)[\Omega] \qquad \text{[Formula 2]:}$$

Here, "D" stands for inner diameter of the outer conductor, while "d" stands for the outer diameter of the inner conductor.

A maximum energy can be transmitted when the impedances between the two signal transmitting means are the same, i.e. when an impedance matching is established between them. However, when impedance changes are shorter than the wavelength, the signal loss by impedance mismatching can be ignored. Though the norm impedances of a coaxial cable are 50Ω, 75Ω, 93-125Ω, etc., a 50Ω cable is generally used as a compromise between a maximum power transmission and a minimum line loss. On the other hand, in communication and broadcasting industries, 75Ω cables are generally used to minimize the line loss. The impedance can be increased by changing diameter of the conductor, or by adding an air gap in the dielectric material If the impedance changes in the course of signal transmission, part of the wave entered into the second medium is reflected. The reflection coefficient can be expressed by the following Formula 3.

$$\text{Reflection Coefficient}=\rho=V_i/V_R=(Z_R-Z_O)/(Z_R+Z_O) \qquad \text{[Formula 3]:}$$

Here, $V_i$ and $Z_O$ are input voltage and impedance, respectively, of the first medium, while $V_R$ and $Z_R$ are input voltage and impedance, respectively, of the second medium.

A reflection loss can be expressed by the following Formula 4.

$$\text{Reflection Loss [dB]}=10\ \text{Log}_{10}[1-(1-\rho^2)] \qquad \text{[Formula 4]:}$$

Figure 10A:
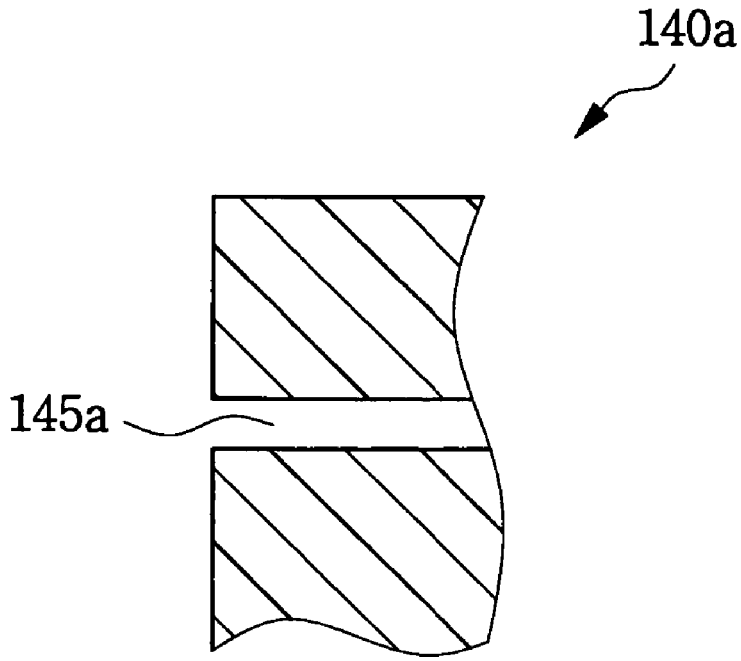
FIG. 10*a* is a partial cross-sectional view of a microwave device suitable for combination with the above first as well as the second embodiments of a connection structure in accordance with the present invention.
Figure 10B:
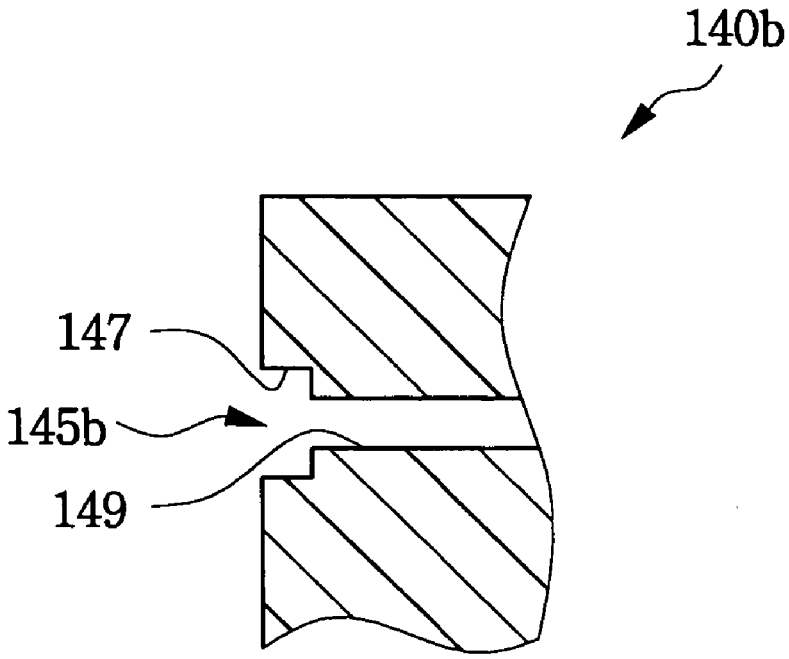
FIG. 10*b* is a partial cross-sectional view of a microwave device suitable for combination with the above third as well as the fourth embodiments of a connection structure in accordance with the present invention.
Figure 13A:
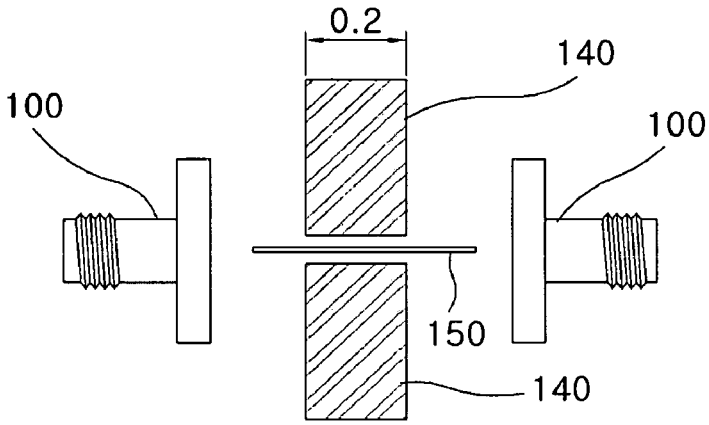
FIG. 13*a* is a cross-sectional view showing combination of a microwave device with connectors in accordance with the present invention, where two connectors are connected by an extendible pin.
Figure 13B:
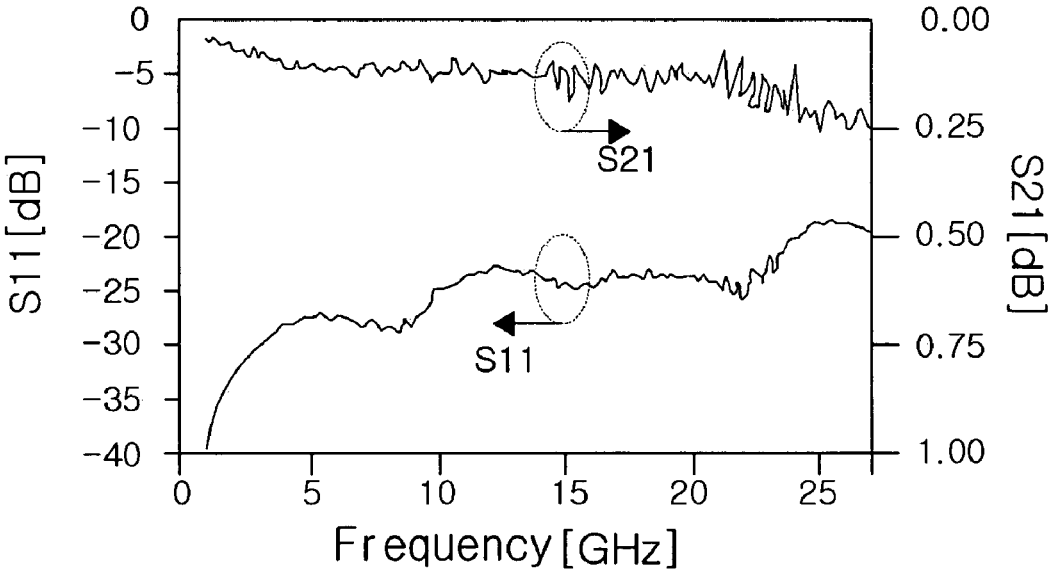
FIG. 13*b* is a graph showing characteristics of a connection structure when combined as in FIG. 13*a*.
Figure 14A:
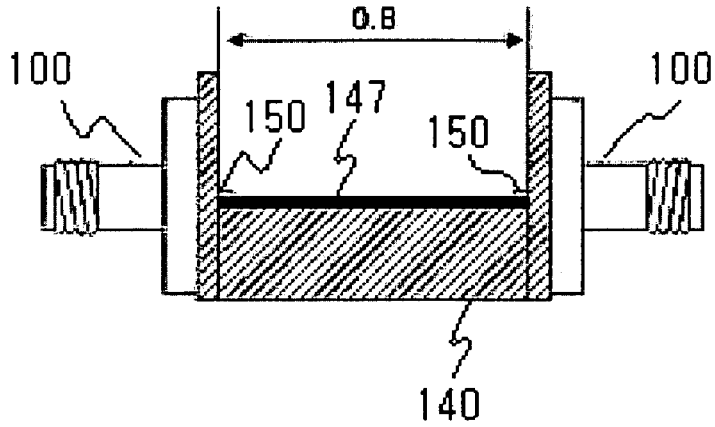
FIG. 14*a* is a cross-sectional view showing combination of a microwave device with connection structures in accordance with the present invention, where two connection structures are connected to a micro strip line of the microwave device.
Figure 14B:
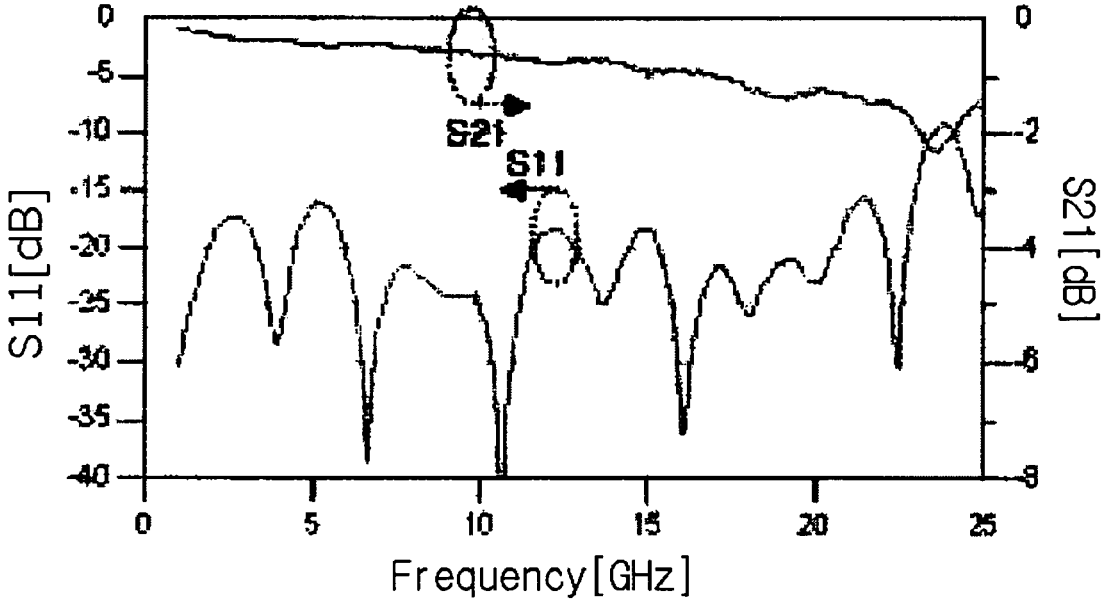
FIG. 14*b* is a graph showing characteristics of a connection structure when combined as in FIG. 14*a*.

When a connection structure of the present invention is combined, for example, with a microwave device 140*b* as in FIG. 10*b*, a reflection loss (S11) of −20 dB, −15 dB, or lower can be obtained as shown in FIGS. 13*b* and 14*b*, so that a power transmission rate of 95% or more can be achieved.

An impedance compensator 160 of a connection structure as per the present invention shall, as shown in FIG. 4*b*, satisfy the conditions, $b \leqq a/5$ and $c \leqq 2b$, when diameter of the impedance compensator 160 is a, thickness thereof is b, and size of the protrusion is c. Where these conditions are not met, an impedance matching is not achieved, and desired reflection characteristics might not be obtained.

If not mentioned otherwise, these conditions apply also to the other embodiments described below.

Second Embodiment

FIGS. 5*a* through 5*d* are cross-sectional views of a second embodiment of a connection structure in accordance with the present invention.

Those parts in the second embodiment identical with the corresponding parts in the first embodiment are indicated with same numerals and an explanation thereof is omitted in the following descriptions. The impedance compensator 160*b* in the second embodiment does not comprise a protrusion, in contrast to the first embodiment. There exists a mechanical difference in the connection structure depending on the transmission line and the thickness of the substrate used in a microwave device. The existence and/or the length of the protrusion can be adjusted to fit the mechanical difference. When considering electrical characteristics, an impedance compensator 160 having no protrusion can be constructed. According to an embodiment of the present invention, an impedance compensator 160*a* with a protrusion can be used when diameter of the extendible pin is 0.2 mm~0.4 mm; while an impedance compensator 160*b* without a protrusion can be used when diameter of the extendible pin is over 0.4 mm.

Third Embodiment

Figure 6:
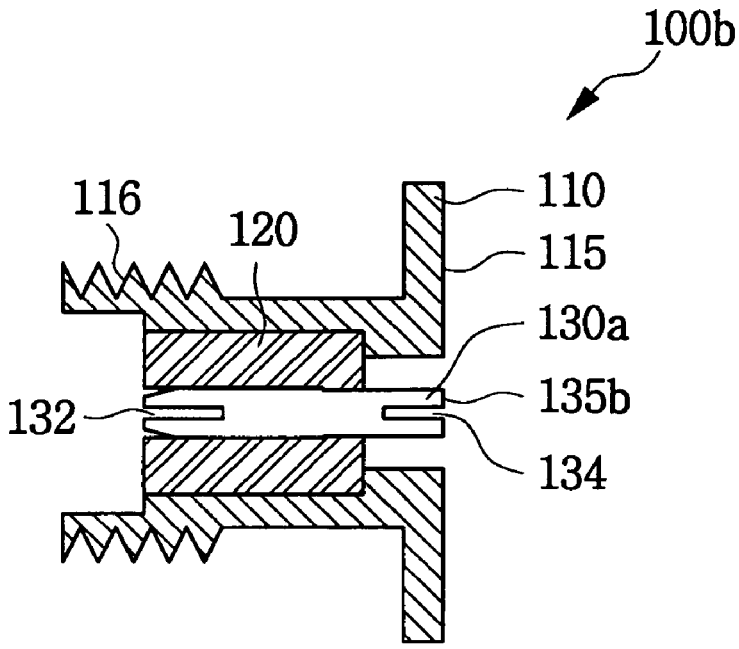
FIG. 6 is a partial cross-sectional view of a third embodiment of a connection structure in accordance with the present invention.

FIG. 6 is a partial cross-sectional view of a third embodiment of a connection structure in accordance with the present invention.

Those parts in the third embodiment identical with the corresponding parts in the above embodiments are indicated with same numerals and an explanation thereof is omitted in the following description. In a connector 100*b* of the third embodiment, the inner conductor 130*a* has a second terminal 134 of which one end 135*b* is on the same level with the terminal surface 115 of the body 110.

Fourth Embodiment

Figure 7:
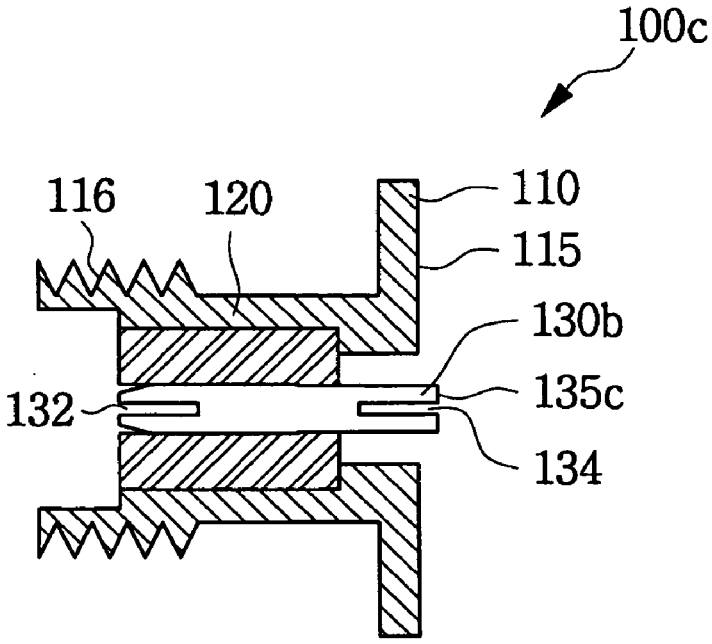
FIG. 7 is a partial cross-sectional view of a fourth embodiment of a connection structure in accordance with the present invention.

FIG. 7 is a partial cross-sectional view of a fourth embodiment of a connection structure in accordance with the present invention.

Those parts in the fourth embodiment identical with the corresponding parts in the above embodiments are indicated with same numerals and an explanation thereof is omitted in the following description. Inner conductor 130*b* of the connector 100*c* in the fourth embodiment has a second terminal 134, of which one end 135*c* protrudes over the level of terminal surface 115 of the body 110 of the connector 100*b*.

Fifth Embodiment

Figure 8A:
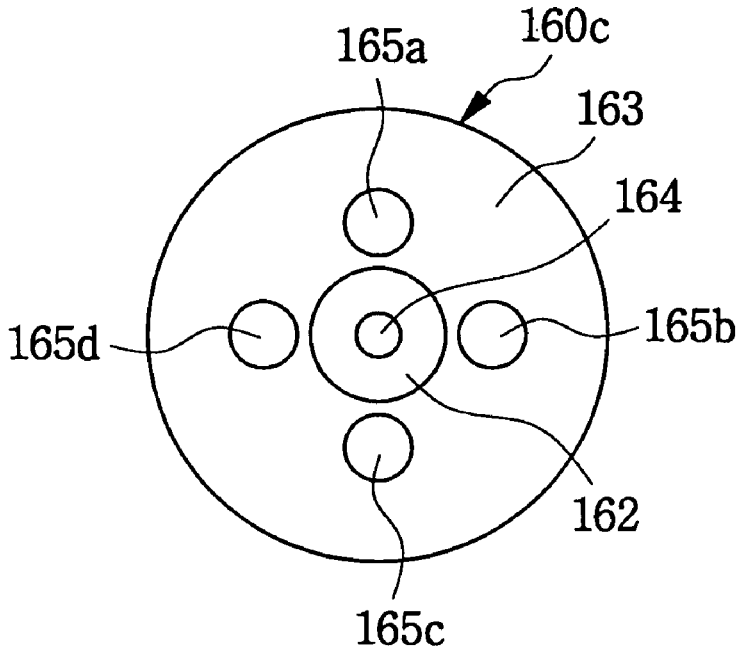
FIGS. 8*a* and 8*b* are a front view and a perspective view, respectively, of the impedance compensator of a fifth embodiment of connection structure in accordance with the present invention.
Figure 8B:
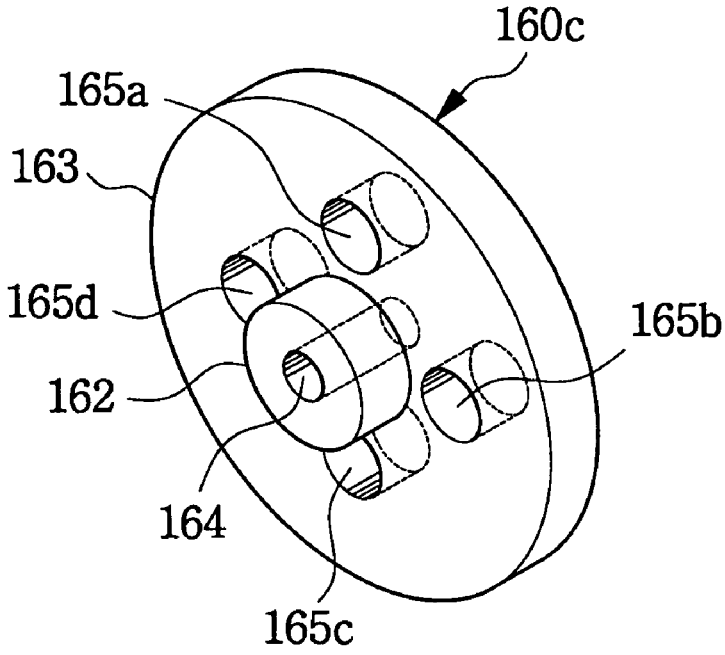

FIGS. 8*a* and 8*b* show the impedance compensator of the fifth embodiment of connection structure in accordance with the present invention.

The impedance compensator 160*c* as per the fifth embodiment comprises a body 163 and a protrusion 162 rising from one side of the body 163. Although this embodiment is same as the above embodiments in that it comprises a protrusion 162 and a hole 164 for insertion of an extendible pin, it differs from the above embodiments in that the body 163 comprises a plurality of through holes 165*a*~165*d* formed therein.

These through holes 165 in the body 163 are formed at regions adjacent to the inner conductor where the most electric fields are gathered when the extendible pin is inserted in the extendible pin insertion hole 164 in order to reduce the capacitance by reducing the effective dielectric rate of these regions. Thus, a capacitance adjustment is possible in the fifth embodiment through modifications of the size and the number of the through holes 165. The through holes 165 are placed preferably at regions between center of the extendible pin insertion hole 164 and locations corresponding to R/2 when the radius of the impedance compensator 160*c* is R, whereby diameter of the through holes 164 can be larger than that of the extendible pin.

Sixth Embodiment

Figure 9A:
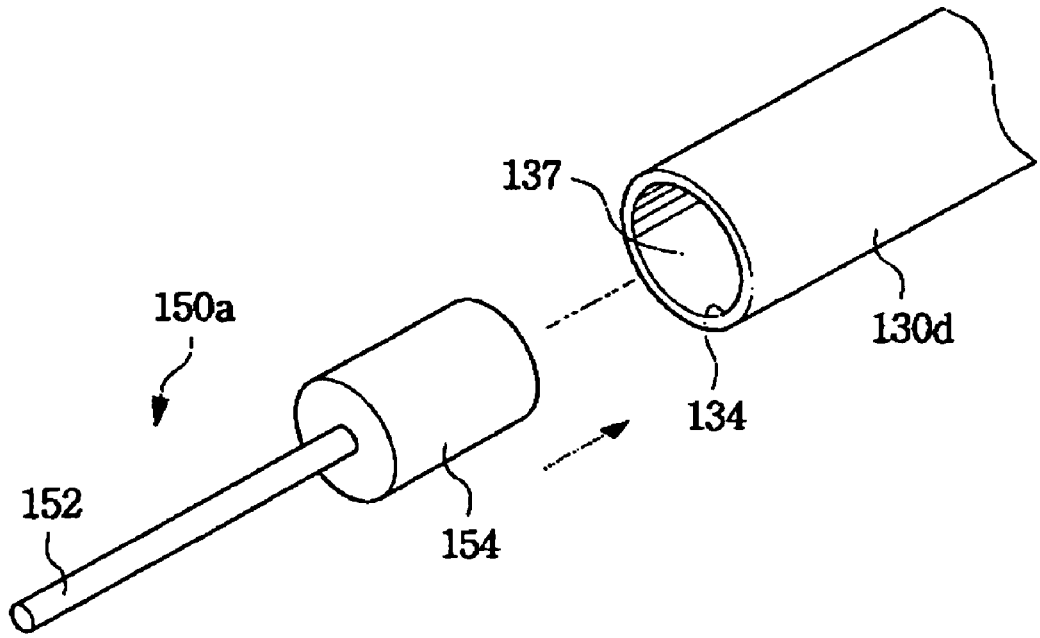
FIGS. 9*a* and 9*b* are partial perspective views showing construction of the extendible pin of a sixth embodiment of a construction structure in accordance with the present invention, and combination thereof with the inner conductor as well as with the impedance compensator.
Figure 9B:
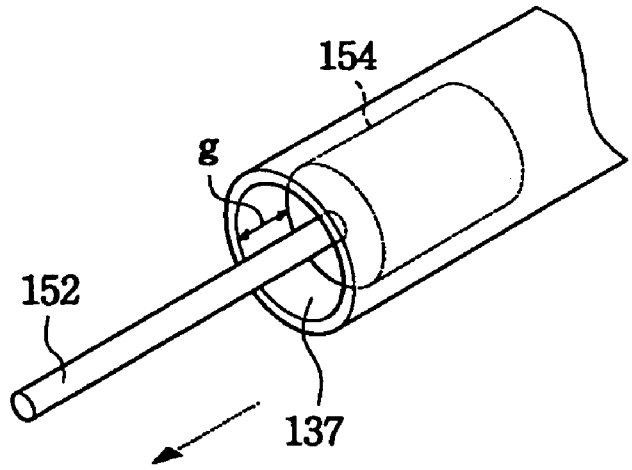

FIGS. 9*a* and 9*b* are partial perspective views showing construction of the extendible pin of the sixth embodiment of a construction structure in accordance with the present invention, and combination thereof with the inner conductor as well as with the impedance compensator.

As shown in the drawing, the extendible pin 150*a* in the sixth embodiment comprises a top part 152 and an extension part 154. While diameter of the top part is identical with that in the above embodiments, the extension part 154 has a diameter suitable for combination with the circular groove 137 formed at the second terminal 134 of the inner conductor 130*d* by insertion. As shown in FIG. 9*b*, top part 152 of the extendible pin 150*a* is inserted in the extendible pin insertion hole 164 of the impedance compensator 160*a* as in the above embodiments, while extension part 154 of the extendible pin 150*a* is inserted in the circular groove 137, whereby the extension part 154 proceeds preferably further into the inner conductor 130*d* so as to form a space, 'g'. Here, the space 'g' functions to reduce the electric fields flowing from the inner conductor 130*a* to the earth. As such, capacitance of the connection structure can be adjusted by modifying the volume of space 'g'.

Figure 9C:
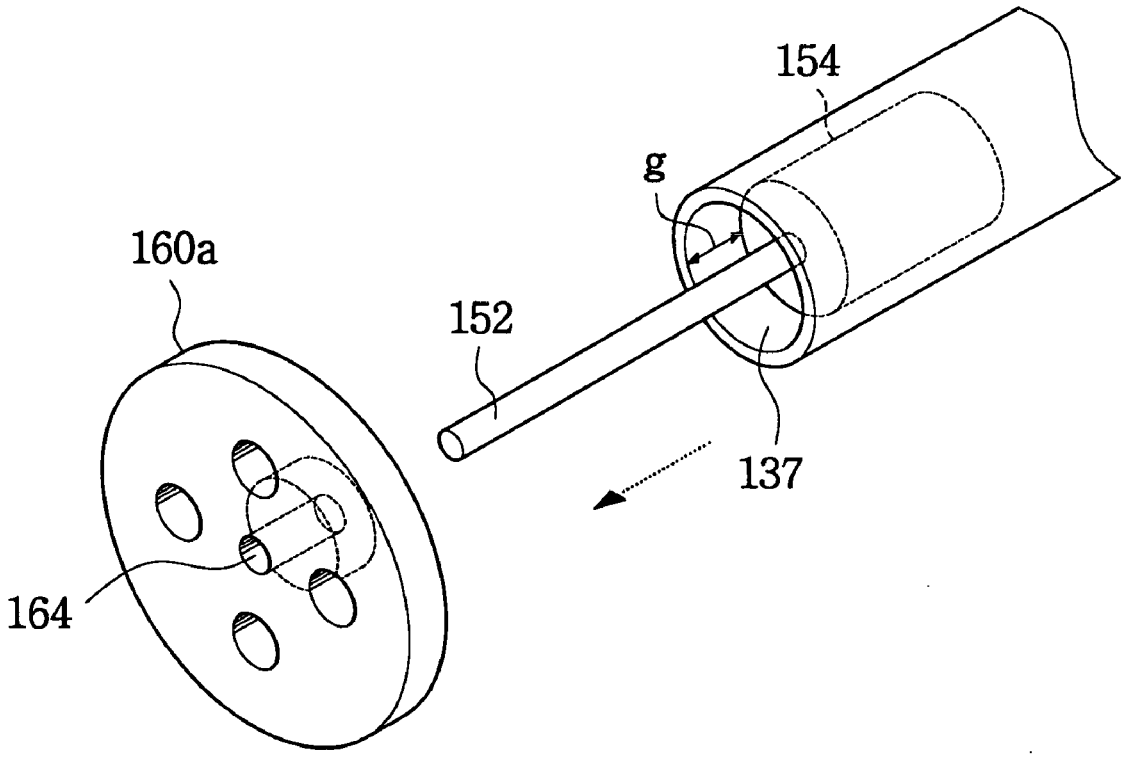
FIG. 9*c* is a partial perspective view showing construction of a varied extendible pin of the sixth embodiment of the construction structure in accordance with the present invention, and combination thereof with the inner conductor as well as with the impedance compensator.

FIG. 9*c* is a partial perspective view showing construction of a varied extendible pin of the sixth embodiment of the construction structure in accordance with the present invention, and combination thereof with the inner conductor as well as with the impedance compensator. In this varied embodiment, extension part 154 of the extendible pin 150*a* is inserted into the circular groove 137 of the inner conductor 130*d* without forming the space 'g'. Notwithstanding this, impedance of the connection structure can be adjusted, for the impedance compensator 160*a* comprises a plurality of through holes 165*a*~165*d*. The function and structure of these through holes 165*a*~165*d* are the same as those described in the above fifth embodiment.

Next, the modified structure of the microwave device 140 is described with reference to the extendible pin insertion hole 145.

As shown in FIG. 10*a*, the extendible pin insertion hole 145*a* of the microwave device 140*a* is formed with a predetermined inner diameter. A microwave device 140*a* with this structure is suitable for combination with a connection structure according to the first or second embodiment of the present invention. Here, the inner diameter of the extendible pin insertion hole 145*a* is, e.g. 0.7 mm.

In FIG. 10*b*, the extendible pin insertion hole 145*b* of the microwave device 140*b* comprises a first insertion part 147 and a second insertion part 149 having each a diameter different from one other, i.e. the hole 145*b* has a step structure. With a microwave device 140*b* of this structure, a connection structure according to the third or fourth embodiment of the present invention can suitably be combined. In such case, diameter of the first insertion part 147 is practically the same as the diameter 'c' of the protrusion 162 of the impedance compensator 160.

Seventh Embodiment

Figure 11A:
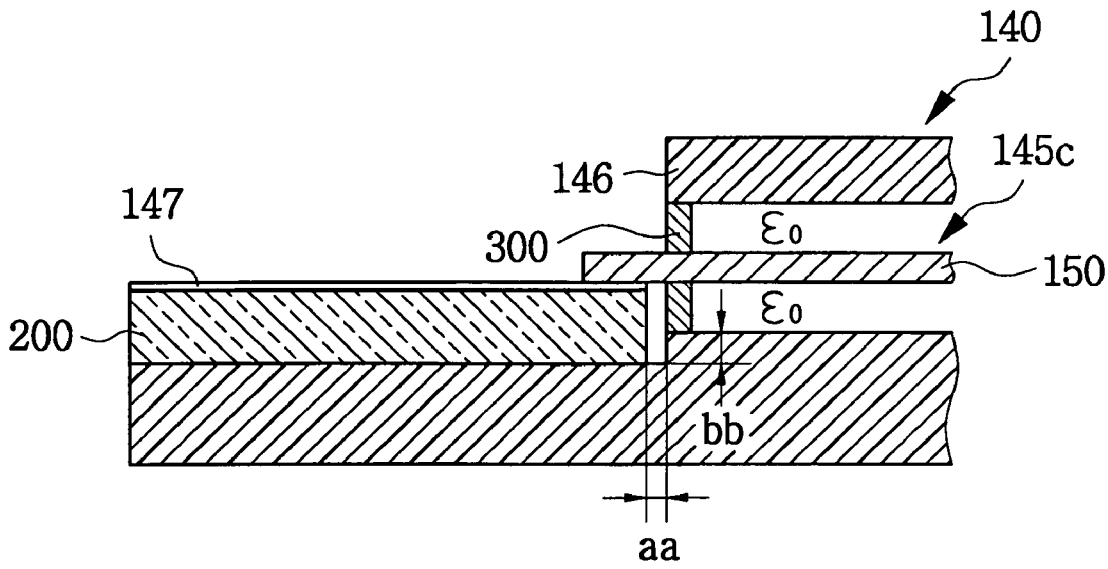
FIG. 11*a* is a partial cross-sectional view showing combination of a seventh embodiment of a connection structure as per the present invention with a microwave device.
Figure 11B:
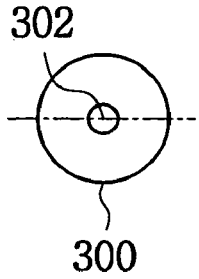
FIGS. 11*b* and 11*c* are a cross-sectional view and a perspective view, respectively, of a dielectric ring used in the seventh embodiment of a connection structure in accordance with the present invention.
Figure 11C:
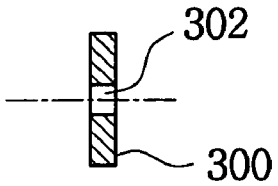

FIG. 11*a* is a partial cross-sectional view showing combination of a seventh embodiment of a connection structure as per the present invention with a microwave device, while FIGS. 11*b* and 11*c* are a cross-sectional view and a perspective view, respectively, of a dielectric ring used in the seventh embodiment of a connection structure in accordance with the present invention. The seventh embodiment aims to improve combination impedance matching when the extendible pin 150 of the connection structure is connected to the transmission line 147 of the microwave device 140.

As shown in FIG. 11*a*, the microwave device 140 comprises an extendible pin insertion hole 145*c* formed in the body wall 146, a substrate 200, and a micro strip transmission line 147 formed on the substrate 200. As inner diameter of the insertion hole 145*c* is bigger than diameter of the extendible pin 150, the extendible pin 150 is surrounded by air $\in 0$. Where the extendible pin 150 passes through the insertion hole 145*c* and enters into the transmission line 147, a dielectric ring 300 is provided for.

The dielectric ring 300 is formed in a ring shape with an extendible pin insertion hole 302 formed in the center thereof. The dielectric ring 300, being made of, e.g. Teflon, functions to compensate the capacitance, and thus, contributes to match an impedance between the extendible pin 150 and the transmission line 147. In addition, the extendible pin 150 preferably passes through the correct center of the insertion hole 145*c*, and the dielectric ring 300 enables not only the self-alignment of the extendible pin 150 but also compensates processing error of the substrate 200 and the body wall 146.

If an arraying of the transmission line 147 with the extendible pin 150 is required due to thickness of the substrate 200 in the seventh embodiment, the substrate is processed by 'bb', corresponding to the insertion space, to yield a stepped structure. Here, the substrate 200 is placed apart from the dielectric ring by a certain distance, 'aa', due to a processing error created by failure of the substrate 200 to correctly fit the body wall 146. Accordingly, there exists a space between the body wall 146 and the substrate 200, which is expressed electrically in L characteristic. The L characteristic can be compensated by capacitance compensation of the dielectric ring 300. In other words, the dielectric ring 300 functions to compensate the processing error.

Eighth Embodiment

Figure 12A:
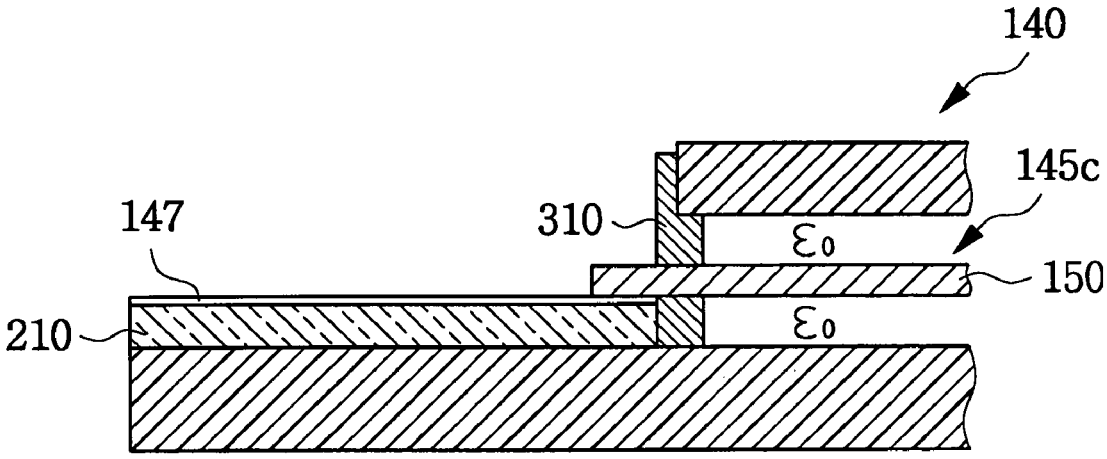
FIG. 12*a* is a partial cross-sectional view showing combination of an eighth embodiment of a connection structure as per the present invention with a microwave device.
Figure 12B:
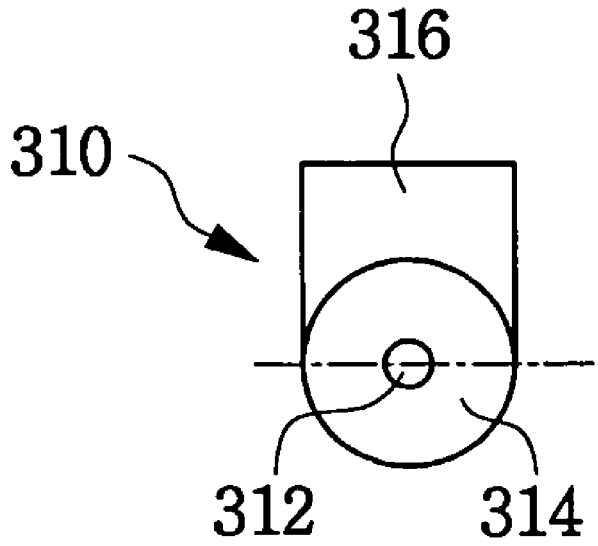
FIGS. 12*b* and 12*c* are a cross-sectional view and a perspective view, respectively, of a dielectric ring used in the eighth embodiment of a connection structure in accordance with the present invention.
Figure 12C:
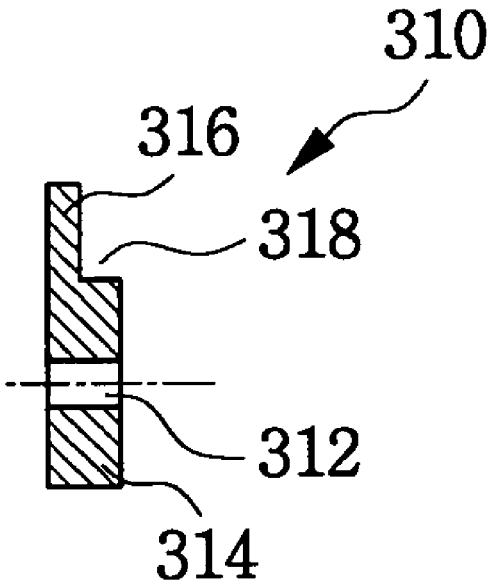

FIG. 12*a* is a partial cross-sectional view showing combination of an eighth embodiment of a connection structure as per the present invention with a microwave device, while FIGS. 12*b* and 12*c* are a cross-sectional view and a perspective view, respectively, of a dielectric ring used in the eighth embodiment of a connection structure in accordance with the present invention.

In the eighth embodiment, arraying of the extendible pin as well as achieving of impedance matching are made using dielectric ring as in the above seventh embodiment. Since the substrate 210 used in the eighth embodiment is thin and the extendible pin 150 can be arrayed on the same surface with the transmission line 147 as shown in FIG. 12*a*, no additional processing is required to be made on the insertion part of the substrate. The dielectric ring 310 used in the eighth embodiment comprises a ring part 314 and a tetragonal support part 316. Although the tetragonal support part 316 is formed monolithic with the ring part 314, it is formed backward from the ring part by the concave part 318, whereby the extendible pin through hole 312 is place at the center of the ring part 314 as shown in FIG. 12*c*.

Referring to FIG. 12*a*, the ring part 314 is combined with the concave part 318 through insertion into the extendible pin insertion hole 145*c*, while the tetragonal support part 316 contacts edge of the body wall 146 of the microwave device 140 and is not inserted into the extendible pin insertion hole 145*c*. The part of the ring part not inserted in the extendible pin insertion hole 145*c* contacts the substrate 210. Accordingly, in the eighth embodiment, there exists no space between the substrate 210 and the body wall 146 of the microwave device 140, to be closed by the dielectric ring 310, in contrast to the seventh embodiment. Thus, the dielectric ring 310 compensates capacitance as in the seventh embodiment, and contributes to achieve an impedance matching between the extendible pin 150 and the transmission line 147. Furthermore, the dielectric ring 310 functions in arraying the extendible pin 150 as well as in compensating the processing errors.

Inventors of the present invention have conducted experiments to prove the insertion and reflection characteristics of a coaxial connector and a connection structure including the same in accordance with the present invention, the results of which are shown in FIGS. 13*a* through 14*b*.

FIG. 13*a* is a cross-sectional view showing combination of a microwave device with connectors in accordance with the present invention, wherein two such connectors are connected by an extendible pin. FIG. 13*b* is a graph showing characteristics of a connection structure combined as in FIG. 13*a*.

In the above drawings, the microwave device 140 is an aluminum test fixture having 0.2 inch width. Two coaxial connectors 100 are connected through an extendible pin 150 with 0.012 inch diameter made of brass. As shown in FIG. 13*b*, the electricity transmission rate was as high as 99%, since the reflection loss (S11) was maintained lower than ca. −22 dB until the frequency reached 20 GHz. The insertion loss (S21) showed favorable characteristics maintaining −0.15 dB.

FIG. 14*a* is a cross-sectional view showing combination of a microwave device with connection structures in accordance with the present invention, wherein two such connection structures are connected to a micro strip line of the microwave device, while FIG. 14*b* is a graph showing characteristics of a connection structure combined as in FIG. 14*a*. It can be seen from FIG. 14*b* that the general characteristics were slightly worsen when two coaxial connectors 100 were connected together through an extendible pin 150 and a transmission line 147, due to the periodic characteristics by length resonance generated in the characteristics graph by the long transmission line 147. However, the present invention has provided even in such case a satisfactory result with an electricity transmission rate of 97%, since the reflection loss (S11) was maintained lower than ca. −15 dB until the frequency reached 20 GHz.

Although the present invention has been described above with reference to the preferred embodiments and the accompanying drawings, the scope of rights of the present invention is not limited thereto, but rather, shall be determined by the claims attached herein after and their equivalents, allowing various modifications and adaptations without departing the spirit of the present invention, as those skilled in the art to which the present invention belongs will understand.

INDUSTRIAL APPLICABILITY

The present invention provides a coaxial connector with superior frequency characteristics and a connection structure including the same, both of which have simple constructions, can easily be manufactured, and show superior characteristics in respect to insertion loss as well as reflection at ultra high frequencies at or over 15 GHz. Furthermore, the present invention, by providing a connection structure having a suitable construction for transmitting signals externally from ultra high frequency module packages through a micro strip transmission line, and by adopting detachable connector bodies, dielectric material as well as connection pins, allows reuse of the connector bodies and the dielectric material.

Moreover, since an impedance matching can be achieved by compensating electric discontinuities through mechanical arraying and a capacitance control can be made by dielectric ring, etc. in the present invention, the present invention can largely enhance the interchangeability as well as adaptability between various forms of connectors and microwave devices.

The invention claimed is:

1. A connection structure for transmission of high frequency signals, comprising a connector body, which constitutes the outer appearance as well as housing of the connector;

an inner conductor installed in said connector, including a first and a second terminals which are placed to face each other;

a dielectric which insulates said connector body from said inner conductor and determines impedance of said connector;

an extendible pin, which is connected electrically to said second terminal of said inner conductor; and an impedance compensation means having a hole for said extendible pin, wherein diameter of said inner conductor remains practically identical between said first and said second terminals, while diameter of said extendible pin is smaller than that of said inner conductor, wherein said impedance compensation means includes a protrusion part formed in the center thereof to protrude toward a location where said extendible pin is connected, wherein said protrusion formed at said impedance compensation means satisfies the conditions $b \leqq a/5$ and $c \leqq 2b$, when diameter of said impedance compensation means is a, thickness thereof is b, and size of said protrusion is c.

2. The connection structure as set forth in claim 1, wherein said impedance compensation means compensates electric discontinuities between said inner conductor and said extendible pin by mechanical arraying with a microwave device to be combined with said connection structure.

3. A coaxial connector used for a connection structure in accordance with claim 1.

4. The coaxial connector as set forth in claim 3, wherein said coaxial connector is any one of SMA connector, N series connector, TNC connector, BNC connectors, F series and G series connector, DIN connector, OSMP connector, SMB connector, MCX connector, SSMT connector, OSMT connector, MMXC connector, 0.141, 0.250, 0.08563, 0.14, RG316, RG188, ½", and ⅞" right angled connector, semi rigid, or semi flexible coaxial cables.

5. A connection structure for transmission of high frequency signals, comprising a connector body, which constitutes the outer appearance as well as housing of the connector;

an inner conductor installed in said connector, including a first and a second terminals which are placed to face each other, said connector body comprising a terminal surface, said second terminal being formed deeper than said terminal surface;

a dielectric which insulates said connector body from said inner conductor and determines impedance of said connector;

an extendible pin, which is connected electrically to said second terminal of said inner conductor; and an impedance compensation means having a hole for said extendible pin, wherein said impedance compensation means includes a protrusion part formed in the center thereof to protrude toward a location where said extendible pin is connected, the impedance compensation means being combined with said connector body in a manner that the surface of said impedance compensation means with said protrusion part fits to the terminal surface of said connector body, and wherein a diameter of said inner conductor remains practically identical between said first and said second terminals, while diameter of said extendible pin is smaller than that of said inner conductor, wherein said protrusion formed at said impedance compensation means satisfies the conditions, $b \leqq a/5$ and $c \leqq 2b$, when diameter of said impedance compensation means is a, thickness thereof is b, and size of said protrusion is c.

6. The connection structure as set forth in claim 1, wherein said impedance compensation means compensates electric discontinuities between said inner conductor and said extendible pin by mechanical arraying with a microwave device to be combined with said connection structure.

7. A coaxial connector used for a connection structure in accordance with claim 1.

8. The coaxial connector as set forth in claim 7, wherein said coaxial connector is any one of SMA connector, N series connector, TNC connector, BNC connectors, F series and G series connector, DIN connector, OSMP connector, SMB connector, MCX connector, SSMT connector, OSMT connector, MMXC connector, 0.141, 0.250, 0.08563, 0.14, RG316, RG188, ½", and ⅞" right angled connector, semi rigid, or semi flexible coaxial cables.

* * * * *